US007410069B2

(12) United States Patent
Hogbring et al.

(10) Patent No.: US 7,410,069 B2
(45) Date of Patent: Aug. 12, 2008

(54) RAILWAY VEHICLE AND A CLAMPING ARRANGEMENT FOR THE FIXATION OF A TOWING ARRANGEMENT IN SUCH VEHICLES

(75) Inventors: Magnus Hogbring, Falun (SE); Lennart Wikström, Västeras (SE)

(73) Assignee: Dellner Couplers AB, Falun (SE)

( * ) Notice: Subject to any disclaimer, the term of this patent is extended or adjusted under 35 U.S.C. 154(b) by 259 days.

(21) Appl. No.: 10/580,682

(22) PCT Filed: Apr. 19, 2005

(86) PCT No.: PCT/SE2005/000564

§ 371 (c)(1),
(2), (4) Date: May 26, 2006

(87) PCT Pub. No.: WO2005/102810

PCT Pub. Date: Nov. 3, 2005

(65) Prior Publication Data

US 2007/0125739 A1 Jun. 7, 2007

(30) Foreign Application Priority Data

Apr. 20, 2004 (SE) ..... 0401017

(51) Int. Cl.
*B61G 7/10* (2006.01)

(52) U.S. Cl. ..... 213/50

(58) Field of Classification Search ..... 213/10, 213/50–61; 280/495

See application file for complete search history.

(56) References Cited

U.S. PATENT DOCUMENTS 1,801,332 A * 4/1931 Clasen et al. ..... 105/420
2,722,897 A * 11/1955 Morey ..... 105/73
2,886,188 A * 5/1959 Steins ..... 213/51
3,587,869 A * 6/1971 Atkinson ..... 213/8
3,913,747 A * 10/1975 Crummett ..... 213/8
3,994,402 A * 11/1976 Young ..... 213/50.5
4,344,541 A * 8/1982 Chierici ..... 213/61
4,555,033 A * 11/1985 Miller ..... 213/51
4,570,807 A * 2/1986 Miller et al. ..... 213/60
4,573,594 A * 3/1986 Kunst et al. ..... 213/51
4,681,040 A * 7/1987 Brodeur et al. ..... 105/3
4,776,474 A * 10/1988 Terlecky et al. ..... 213/64
4,848,611 A * 7/1989 Terlecky et al. ..... 213/64

(Continued)

FOREIGN PATENT DOCUMENTS

WO WO 2005023618 A1 * 3/2005

(Continued)

*Primary Examiner*—J. Allen Shriver
*Assistant Examiner*—Jason C Smith
(74) *Attorney, Agent, or Firm*—Young & Thompson

(57) ABSTRACT

A clamping arrangement (3) for the fixation of a towing arrangement (2), equipped with a mounting flange (14), in a mounting pocket (6) included in a vehicle underframe (1) and being of the type that includes front and rear pairs of stop lugs (11, 12). The clamping arrangement includes a form-stiff insert (4) as well as a clamping device (5), which is applicable between the insert (4) and the mounting flange (14) of the towing arrangement (2) in order to press apart these and thereby clamp the mounting flange (14) against the front pair of lugs (11). A railway vehicle, e.g. a railroad car, provided with a towing arrangement is also disclosed.

20 Claims, 5 Drawing Sheets

U.S. PATENT DOCUMENTS

Figure 1:
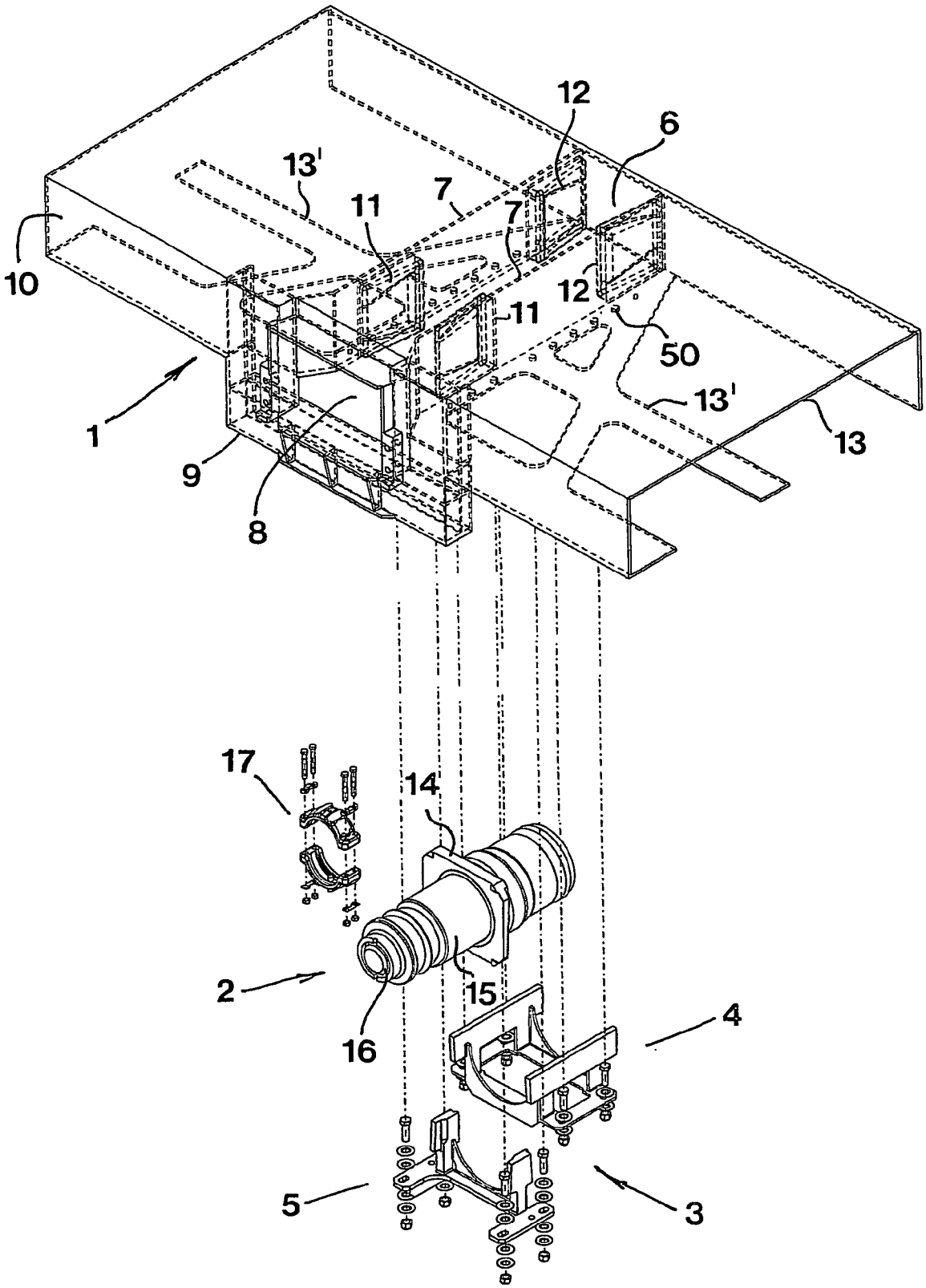

| | | | | | |
|---|---|---|---|---|---|
| RE33,012 | E | * | 8/1989 | Howard | 280/432 |
| 5,176,268 | A | * | 1/1993 | Manley | 213/56 |
| 5,305,899 | A | * | 4/1994 | Kaufhold | 213/50 |
| 5,312,007 | A | * | 5/1994 | Kaufhold et al. | 213/75 R |
| 5,360,124 | A | * | 11/1994 | Wurzer et al. | 213/62 R |
| 5,360,125 | A | * | 11/1994 | Dawson et al. | 213/62 R |
| 6,712,231 | B1 | * | 3/2004 | Ernst et al. | 213/75 R |
| 2007/0125739 | A1 | * | 6/2007 | Hogbring et al. | 213/75 R |
| 2007/0175851 | A1 | * | 8/2007 | Hogbring | 213/62 R |
| 2008/0012335 | A1 | * | 1/2008 | Westman et al. | 285/406 |

FOREIGN PATENT DOCUMENTS

| | | | | |
|---|---|---|---|---|
| WO | WO 2005023619 | A1 | * | 3/2005 |
| WO | WO 2005032906 | A1 | * | 4/2005 |
| WO | WO 2005075272 | A1 | * | 8/2005 |

* cited by examiner

RAILWAY VEHICLE AND A CLAMPING ARRANGEMENT FOR THE FIXATION OF A TOWING ARRANGEMENT IN SUCH VEHICLES

TECHNICAL FIELD OF THE INVENTION

In a first aspect, this invention relates to a rail-way vehicle of the type that comprises an underframe, in which a mounting pocket is included for the attachment of a towing arrangement having a mounting flange, two pairs of axially spaced-apart shoulders being arranged in the mounting pocket, between which shoulders the mounting flange is located together with a clamping arrangement with the purpose of fixing the mounting flange together with the towing arrangement in relation to the underframe.

In a second aspect, the invention also relates to a clamping arrangement for the mounting and fixation of towing arrangements in such vehicles.

DESCRIPTION OF THE PRIOR ART

Although arrangements of the type that has been mentioned above in practice have the purpose of transferring, between different vehicles or vehicle units, such as cars and/or locomotives, in a train unit, not only tractive forces, but also thrust forces, the same are commonly denominated "towing arrangements" by those skilled in the art. Characteristic of such towing arrangements is that the same include a registration arm (usually in the shape of a tube), which at a rear end in one way or the other is fixed in one of the ends of a frame work or underframe included in the vehicle in question, and which at a front end is connected to one or more additional details so as to form a coupler. For instance, the front end of the registration arm may be directly connected to a coupler head and together with the same form an automatic coupler, which can be coupled together with an analogous coupler on another vehicle. However, it is also feasible to connect the registration arm, via a muff coupling or the like, with a collision protection, which in turn is connected to a coupler head. In the towing arrangement, means is usually also included in order to absorb shocks of moderate character, i.e., such shock motions that every day arise and are transferred between connected vehicles, during travel, as well as in connection with the proper coupling operation.

In many cases, the vehicle underframes are formed with standardized mounting pockets, of the type that initially has been mentioned. Such a pocket is in the form of a downwardly open hollow space, which is delimited by two parallel and laterally spaced-apart, vertical walls, which are provided with two pairs of axially spaced-apart shoulders or lugs. Previously, the towing arrangements have been fastened into the standard mounting pockets by means of a clamping arrangement in the form of a spring pile, which initially has been compressed by being prestressed in order to be containable between said pairs of lugs, after which the spring pile has been allowed to expand during clamping between the two pairs of lugs. More precisely, said spring pile consists of, on one hand, a front set of hard rubber bodies, which are mounted between a front supporting plate and a mounting flange or fastening part located at the rear end of the towing arrangement, and on the other hand a rear set of rubber bodies, which are located between the mounting flange and a rear supporting plate in the pile. Between said supporting plates, a central rod having a jamb nut extends, by means of which the supporting plates can be approached towards each other during compression of the rubber bodies. When the spring pile has been applied in the mounting pocket, the nut is released, the rubber bodies expanding and clamping the supporting plates by great force against the front and rear pairs of lugs in the mounting pocket.

An aggravating disadvantage in practice of the above-mentioned construction solution is that the registration arm of the towing arrangement, and thereby the coupler in its entirety, becomes unelastically connected to the vehicle underframe, something which results in that substantially all the motions that a coupler is subjected to during travel compulsorily will be taken up in the coupler heads in two connected couplers. By in this way taking up all varying tractive, thrust, rotary, swivelling and tilting motions in the interface between two connected coupler heads, leads, among other things, to damage on the couplers and premature wear of the same.

OBJECTS AND FEATURES OF THE INVENTION

The present invention aims at obviating the above-mentioned disadvantages of coupler-equipped railway vehicles of the type that includes standardized mounting pockets of the type initially mentioned, and at providing an improved vehicle, more precisely by improving the vehicle's attachment of occurring towing arrangements. Thus, a primary object of the invention is to provide a railway vehicle having a towing arrangement, which is, on one hand, steadily and reliably fixed in the underframe of the vehicle, but on the other hand constructed in such a way that the registration arm thereof is flexibly movable. Another object of the invention is to provide a vehicle, the individual towing arrangement of which can be mounted and dismounted in a simple way in the mounting pocket of the underframe. Yet an object of the invention is to provide a vehicle, the individual towing arrangement of which, without complications, can be made with an integrated collision protection.

According to the invention, at least the primary object is attained by the features that are defined in the characterizing clause of claim 1. Preferred embodiments of the vehicle according to the invention are further defined in the dependent claims 2-9.

In a second aspect, the invention also relates to a clamping arrangement for the fixation of towing arrangements in standard mounting pockets of the type initially mentioned. The features of this clamping arrangement are seen in the independent claim 10. Preferred embodiments of the clamping arrangement according to the invention are further defined in the dependent claims 11-20.

BRIEF DESCRIPTION OF THE APPENDED DRAWINGS

Figure 2:
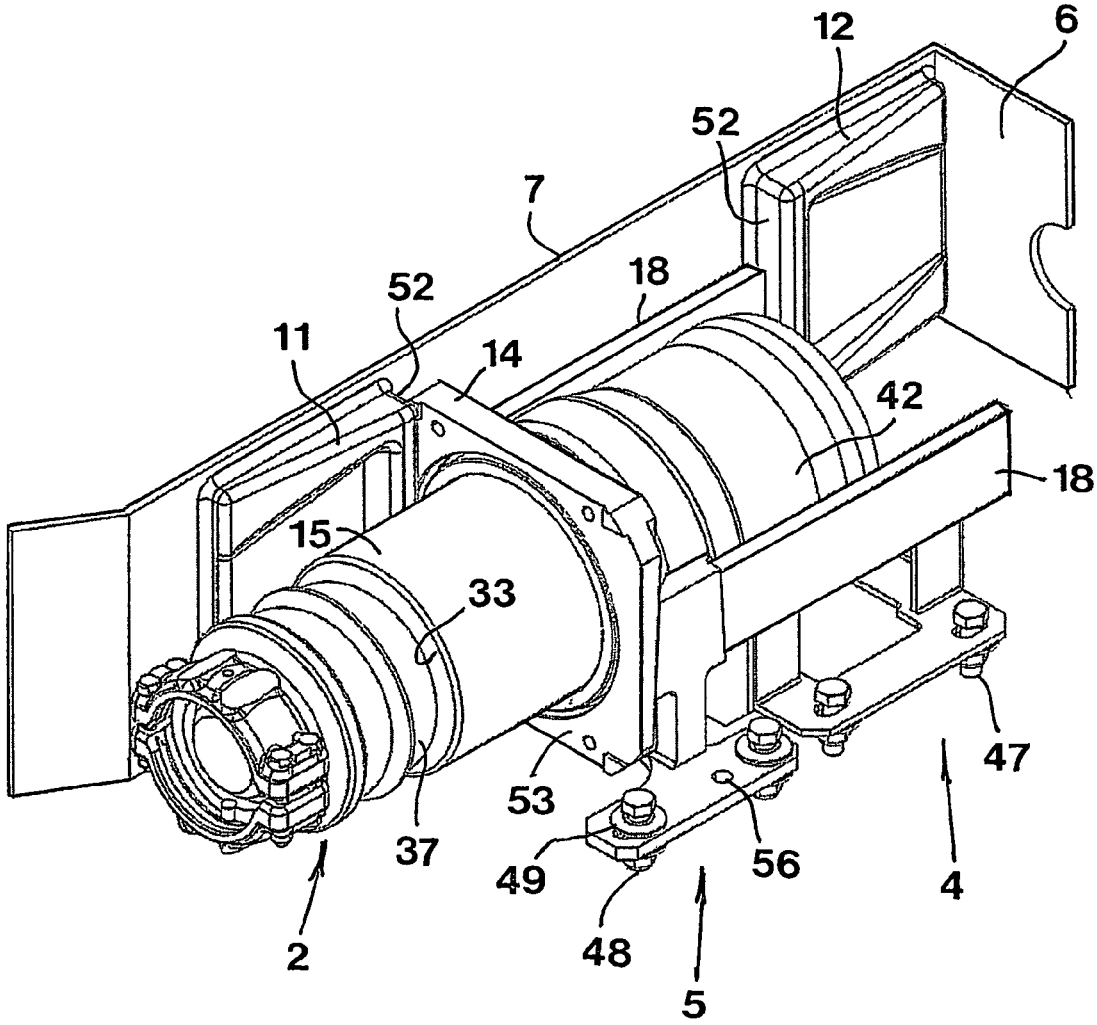
Figure 3:
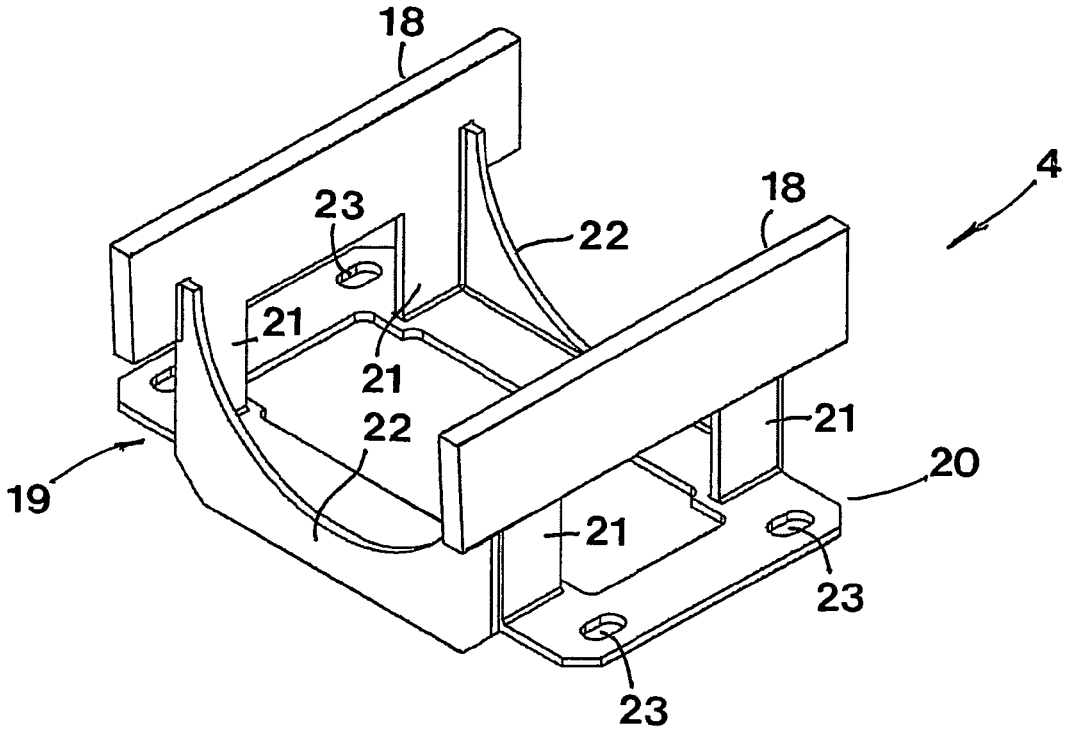
Figure 4:
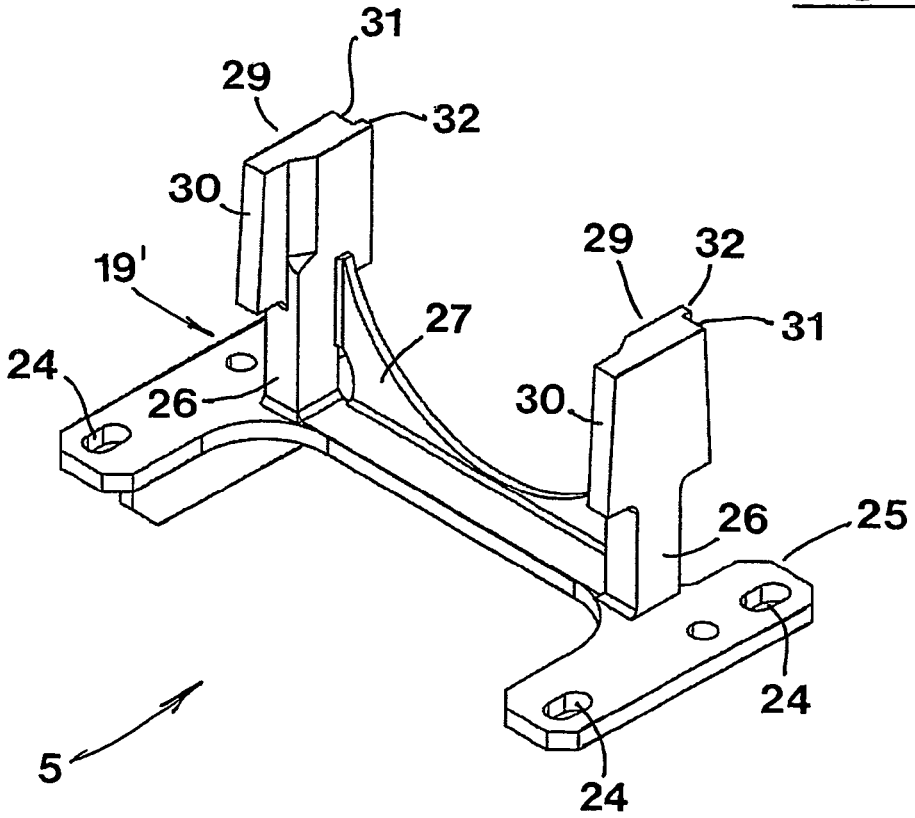
Figure 5:
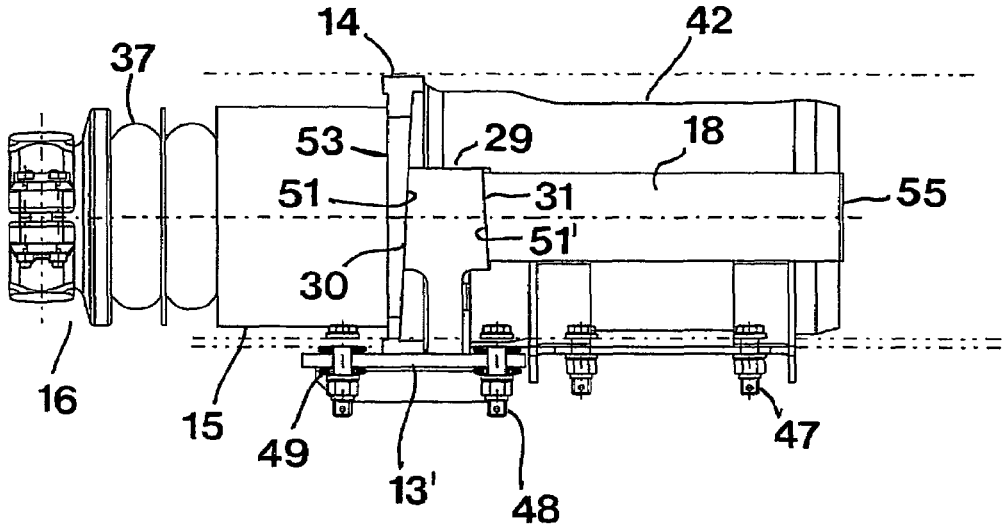
Figure 6:
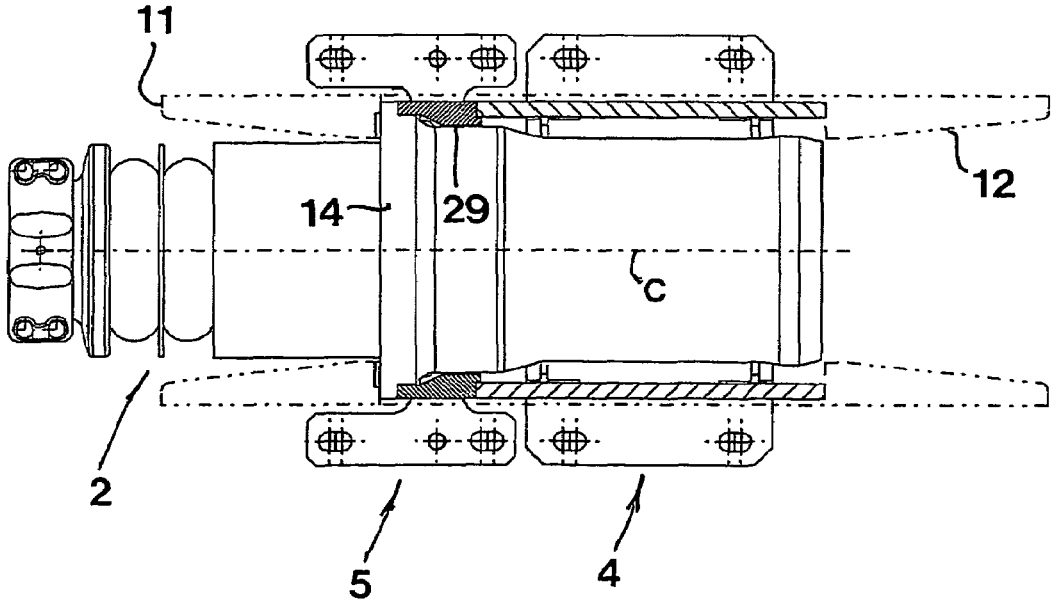
Figure 7:
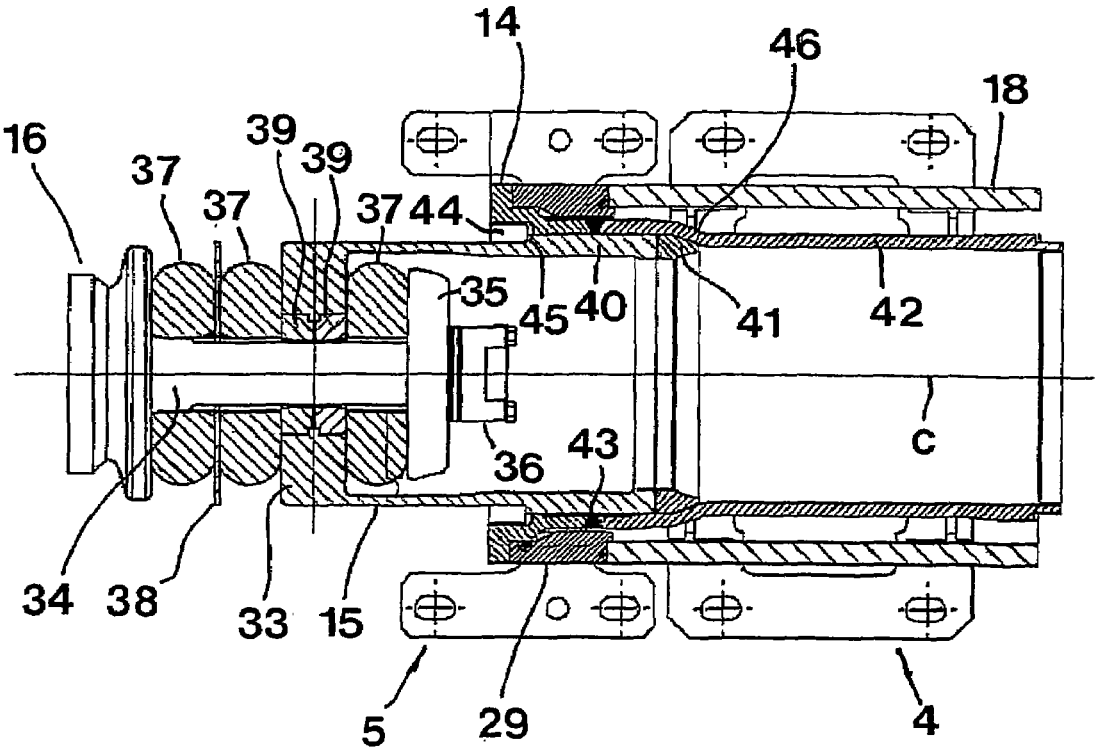

In the drawings:

FIG. 1 is a perspective exploded view of a vehicle underframe having a standard mounting pocket, as well as a separately shown towing arrangement and a clamping arrangement for the mounting of the towing arrangement in the mounting pocket of the underframe, FIG. 2 is an enlarged, partial perspective view showing the towing arrangement mounted in the mounting pocket by means of the clamping arrangement, FIG. 3 is a perspective view of an insert included in the clamping arrangement, FIG. 4 is a perspective view of a clamping device cooperating with the insert, which clamping device together with the insert forms said clamping arrangement, FIG. 5 is a side view of the towing arrangement together with the clamping arrangement, FIG. 6 is a planar view regarded from above in FIG. 6, and FIG. 7 is a longitudinal section showing the inside of the towing arrangement.

DETAILED DESCRIPTION OF THE PREFERRED EMBODIMENT OF THE INVENTION

In FIG. 1, numeral 1 generally designates a partially shown vehicle underframe, while numeral 2 designates a towing arrangement for the mounting in the underframe. At the bottom in FIG. 1, a clamping arrangement in its entirety designated 3 is shown, which includes two separate parts, namely an insert 4 and a clamping device 5.

In the underframe 1, a standardized mounting pocket 6 is included, which is delimited by two vertical walls 7, and which opens in a front opening 8. This opening, which is surrounded by a mounting 9, is located at one of the two ends of a vehicle, e.g. of a railroad car, such as this is defined by a front wall 10 of the underframe 1. On the insides of the walls 7, four lugs or shoulders are formed, namely a front pair of lugs 11 and a rear pair of lugs 12. At the top, the pocket or hollow space 6 is delimited by a sheet-metal plate 13 included in the underframe, and opens in the downward direction. On both sides of the pocket, there are base frame pieces 13'. Generally, the pocket is of an elongate shape and extends in the length extension of the vehicle.

The towing arrangement 2, which will be described more in detail below, reference being made to FIG. 7, includes an external mounting flange 14. In the forward direction, from said mounting flange, a pipe-sleeve coupling 15 extends, which at the front thereof end is connected to a registration arm 16. By means of a muff coupling 17, said registration arm can be built together with one or more other components (not shown) for the formation of a coupler, which in front has a coupler head by means of which the coupler can be coupled together mechanically with a corresponding coupler on another vehicle.

Reference is now made to FIGS. 3 and 4, which illustrate the insert 4 and the clamping device 5 that together form the clamping arrangement 3 characteristic for the invention.

The insert 4 (see FIG. 3) includes two laterally spaced-apart, form-stiff spacing elements 18, which are inter-connected via a lower stand 19. This stand 19 is composed of a base frame 20 as well as two pairs of uprights 21, which carry the spacing elements on a level above the base frame 20. Between the two spacing elements 18 and the uprights 21 thereof, stiffening members 22 extend with the purpose of counteracting deformation of the spacing elements. In practice, the insert may be made from welded sheet-metal plate, the spacing elements 18 consisting of flat, robust sheet-metal plate pieces having elongate, rectangular basic shape. The material in the insert may advantageously consist of steel. In the base frame 20, on the outside of the spacing elements 18, holes 23 of an elongate shape are recessed.

The clamping device 5 shown in FIG. 4 has general similarities to the insert 4, so far that the same includes a bottom piece 25 formed with elongate holes 24, on which bottom piece two uprights 26 are attached, between which a stiffening member 27 extends. The bottom piece 25, the stiffening member 27 and the uprights 26 together form a form-stiff frame 19'. At the top, each individual upright 26 includes a wedge member in its entirety designated 29. In the shown, preferred embodiment, the individual wedge member 29 includes two wedge surfaces, namely a front wedge surface 30 and a rear wedge surface 31, both of which are inclined in relation to the vertical extension of the upright, so that they converge in the direction upward. In connection with each rear wedge surface 31, there is a short, rearwardly projecting flange 32. It should be noted that these flanges 32 are located inside the wedge surfaces 31.

Reference is now made to FIG. 7, which illustrates the nature of the towing arrangement 2. In front, the pipe-sleeve coupling 15 ends in an end wall or end plate 33, in which there is a through hole, through which a rod 34 extends, which at the rear end thereof carries a disc 35 and a retaining element 36, e.g., in the form of a nut, which is tightened on a female thread (not visible) on the rear end of the rod 34. Behind the end wall 33, a first, shock-absorbing spring member 37 is arranged. In front of the end wall, there are two such spring members 37, which are spaced apart by a washer 38. All said spring members 37 may advantageously consist of cushions or bodies of an elastically deformable material, e.g., rubber, but they could also consist of mechanical compression springs, e.g., cup springs or screw springs. The hole recessed in the end wall 33 has. a larger cross section area than the rod 34, in the ring-shaped space between the rod and the hole edge surface two spring bodies 39 of an elastically deformable material being inserted, such as rubber. The contour shape of these bodies, as well as the cross section shape of the hole, may advantageously be square or in another way out of round, so that the bodies cannot be angularly displaced in the hole. In an analogous way, the rod 34 has an out of round cross section shape corresponding to a likewise out of round cross section shape of the central hole in the bodies 39, which the rod runs through. In such a way, the bodies 39 form a torsion suspension that, on one hand, guarantees a certain latitude for the rod 34 and the appurtenant registration arm 16 to be angularly displaced, but that on the other hand always brings back the rod and the registration arm to a desired starting or normal position. Furthermore, the spring members 37 guarantee a range of movement for the registration arm in the axial direction, irrespective of the towing arrangement being applied tractive forces or thrust forces.

The rear end portion 40 of the pipe-sleeve coupling 15 is thickened and connected to a cone 41 in the form of a ring having an external conical surface. This cone 41 is inserted into a deformation tube designated 42, which is stiffly united to the mounting flange 14 via a weld 43. The pipe-sleeve coupling 15 and the cone 41 thereof are kept in place in the deformation tube by means of an externally threaded clamp ring 44, which is pressed against a ring-shaped shoulder surface 45 on the thickened portion 40 of the pipe-sleeve coupling. The external thread of the clamp ring is in engagement with a female thread on the inside of the mounting flange 14. By virtue of the clamp ring 44, movement of the pipe-sleeve coupling in the forward direction out of the deformation tube is made impossible. In normal circumstances, neither it is possible for the pipe-sleeve coupling 15 to move rearward inside the deformation tube 42 because the clamp ring 44 holds the cone 41 pressed or prestressed against a conical waist 46, which separates a front, wide section of the. tube 42 from a rear, thinner section. Only in connection with a possible collision accident, when the coupler is subjected to considerable axial thrust forces, the pipe-sleeve coupling 15 is set in movement in the backward direction under deformation of the tube 42.

Reference is now made to FIG. 2, which illustrates the towing arrangement 2 and the co-operating clamping arrangement mounted in the mounting pocket 6 of the vehicle underframe. Mounting of the insert 4 of the clamping arrangement is carried out by means of screws 47 applied in the holes 23. In an analogous way, the clamping device 5 is mounted by means of screws 48 in the holes 24. Said screws 48 co-operate with spring washers or spring elements 49, which have the purpose of always applying an upwardly directed spring force to the wedge members 29. Upon mounting, the insert 4 is inserted from below into the downwardly open pocket 6 and is fastened to the underframe by the fact that the screws 47 are tightened provisionally in holes 50 (see FIG. 1) in the bottom pieces 13' of the underframe. In the next step, the towing arrangement 2 is brought up in the pocket, where it is kept in place provisionally by means of means, not shown. Finally, also the clamping device 5 is brought up, more precisely with the wedge members 29 being located in the space between the mounting flange 14 and the front ends of the spacing elements or plates 18. As is clearly seen in FIG. 5, the mounting flange 14 is (along the two opposite side edges thereof) formed with wedge surfaces 51 having the same wedge angle as a front surface 30 of the wedge members 29. Furthermore, the front end surface 51' of each spacing element 18 is inclined while forming a wedge surface having the same wedge angle as a rear surface 31 of the individual wedge member 29. In this connection, it should be pointed out that the mutually facing shoulder surfaces 52 of the lugs 11, 12 are vertical, and therefore the front surface 53 of the mounting flange 14 extends in a plane perpendicular to the geometrical longitudinal axis of the towing arrangement. In an analogous way, the rear end surface 55 of the individual spacing element 18 extends perpendicularly to the longitudinal axis of the spacing element.

When the wedge members 29 initially have been brought up in the space between the wedge surfaces 51, 51', the clamping device 5 is fastened provisionally by means of the screws 48. Next, the mounting process is concluded by the same screws being tightened by a certain minimum torque, the wedge members by great force, via wedge action, pressing, on one hand, the mounting flange 14 in the forward direction against the shoulder surfaces 52 of the lugs 11, at the same time as the spacing elements 18 are pressed with the end surfaces 55 thereof against the shoulder surfaces 52 of the rear lugs 12. During this operation, not only the clamping device 5, but also the insert 4 can move axially in either direction thanks to the elongate shape of the holes 23, 24 for the screws 47, 48. When the mounting flange 14 has been fixed distinctly in the end position thereof, also the screws 47 are finally tightened.

In the mounted state, the deformation tube 42, as well as the pipe-sleeve coupling 15 connected with the same, is hold distinctly and reliably in the given position thereof in relation to the vehicle underframe because the mounting flange 14 is kept clamped in the described way. However, thanks to the spring members 37 and the spring bodies 39, respectively, the forwardly projecting registration arm 16 is flexibly movable in relation to the pipe-sleeve coupling 15. Thus, the rod 34 united to the registration arm 16 can move axially rearward as well as forward against the action of the spring members 37. Simultaneously, the rod cannot only be angularly displaced in relation to the geometrical centre axis C of the towing arrangement, but also turn upward as well as downward in relation to the same.

Hence, a substantial advantage of the invention is that the registration arm (and other components that together with the same form a coupler) of the towing arrangement is flexibly movable at the same time as the towing arrangement in its entirety is fixed in the vehicle underframe in a stable and reliable way. Furthermore, the deformation tube 42 serves as collision protection, which to a large extent alleviates the effects of any serious collision accident.

In conclusion, it should be pointed out that the bottom piece 25 of the clamping device 5 includes holes 56 (see FIG. 2) for screw devices (not shown) by means of which the clamping device in its entirety can be pulled down by great force in connection with a possible dismounting of the towing arrangement out of the mounting pocket.

Feasible Modifications of the Invention

The invention is not limited only to the embodiment described above and shown in the drawings. Thus, the design of the distance-keeping insert, as well as the clamping device co-operating with the same, may be varied in a plurality of ways within the scope of the subsequent claims. For instance, the clamping device may include other clamping or pressing means than just wedges. Thus, instead of wedges, for instance, eccentric or screw mechanisms may serve the purpose of separating the mounting flange and the spacing elements, so as to clamp the mounting flange. It is also possible to construct the lower frames in the insert as well as the clamping device in another way than the one shown in detail in the drawings.

The invention claimed is:

1. Railway vehicle comprising an underframe (1), in which a mounting pocket (6) is included for the attachment of a towing arrangement (2) having a mounting flange (14), two pairs of axially spaced-apart shoulders (11, 12) being arranged in the mounting pocket (6), between which shoulders the mounting flange (14) is located together with a clamping arrangement (3) with the purpose of clamping the mounting flange against a first pair of shoulders (11), and thereby fixing the towing arrangement in relation to the underframe, characterized in that the clamping arrangement (3) comprises a form-stiff insert (4) as well as a clamping device (5) acting between the same and the mounting flange (14), which device aims to retreat the mounting flange (14) and the insert (4) from each other, and thereby guarantee clamping of the mounting flange (14) against said first pair of shoulders (11), at the same time as the insert is clamped against the second pair of shoulders (12).

2. Vehicle according to claim 1, characterized in that the insert (4) includes two laterally spaced-apart, form-stiff spacing elements (18), which are inter-connected via a lower stand (19), which is fastened against the bottom side of the underframe (1).

3. Vehicle according to claim 2, characterized in that the stand (19) of the insert (4) is composed of, on one hand, a base frame (20) having means (23) for the fastening of the same against the underframe (1), and on the other hand two pairs of uprights (21), which carry the spacing elements (18) on a level above the base frame (20).

4. Vehicle according to claim 3, characterized in that the fastening means consist of elongate holes (23), and screws (47) applied in the same, which screws are tightened in threaded holes (50) in the underframe (1).

5. Vehicle according to claim 1, characterized in that the clamping device (5) includes two laterally spaced-apart wedge members (29), which are inter-connected via a lower frame (19') and wedged-in between the insert (4) and the mounting flange (14).

6. Vehicle according to claim 5, characterized in that the frame (19') of the clamping device (5) is composed of, on one hand, a bottom piece (25) having elongate holes (24) for screws (48), and on the other hand two uprights (26), on which the wedge members (29) are carried.

7. Vehicle according to claim 5, characterized in that the individual wedge member (29) has two opposite wedge surfaces (30, 31), which converge in the direction upward, and are pressed against inclined contact surfaces (51, 51') of the mounting flange (14) and the insert (4), respectively.

8. Vehicle according to claim 1, characterized in that the towing arrangement (2) comprises a registration arm (16), which at the rear includes an axial rod (34), which projects through a through hole in a plate (33), which on both sides is surrounded by shock-absorbing spring members (37), which always aim to hold the rod in an starting position in relation to the plate, and against the action of which the rod together with the registration arm are movable.

9. Vehicle according to claim 8, characterized in that the plate (33) is included in a mandrel (15, 40) that is equipped with a cone (41) and inserted into a deformation tube (42) serving as collision protection, more precisely into a wide, front tube section, which via a waist (46) transforms into a thinner, rear tube section, which is deformable by the penetration of the mandrel.

10. Clamping arrangement for the fixation of a towing arrangement (2), equipped with a mounting flange (14), in a mounting pocket (6) included in a vehicle underframe (1) and having two pairs of axially spaced-apart shoulders (11, 12), characterized in that the same comprises a form-stiff insert (4) as well as a clamping device (5), which is applicable between the insert (4) and the mounting flange (14) of the towing arrangement in order to press apart these and thereby clamp the mounting flange against a first pair of shoulders (11).

11. Clamping arrangement according to claim 10, characterized in that the insert (4) includes two laterally spaced-apart, form-stiff spacing elements (18), which are inter-connected via a lower stand (19).

12. Clamping arrangement according to claim 11, characterized in that the stand (19) of the insert (4) is composed of, on one hand, a base frame (20) having means (23) for the fastening of the same against a vehicle underframe, and on the other hand two pairs of uprights (21), which carry the spacing elements (18) on a level above the base frame (20).

13. Clamping arrangement according to claim 12, characterized in that the fastening means consist of holes (23) intended for the receipt of screws, which holes have an elongate shape in order to enable displacement in relation to provisionally tightened screws.

14. Clamping arrangement according to claim 12, characterized in that, between the two spacing elements (18) together with the uprights (21) thereof, stiffening members (22) extend with the purpose of counteracting deformation of the spacing elements.

15. Clamping arrangement according to claim 11, characterized in that the individual spacing element consists of a flat and long narrow metal body (18).

16. Clamping arrangement according to claim 10, characterized in that the clamping device (5) includes two laterally spaced-apart wedge members (29), which are inter-connected via a lower frame (19') having means (24) in order to enable wedging-in of the wedge members between an insert and a mounting flange.

17. Clamping arrangement according to claim 16, characterized in that the frame (19') of the clamping device is composed of, on one hand, a bottom piece (25) having said wedging-in means (24), and on the other hand two uprights (26), on which the wedge members (29) are carried.

18. Clamping arrangement according to claim 17, characterized in that, between the two wedge members (29) together with the uprights (26) thereof, a stiffening member (27) extends with the purpose of counteracting deformation of the wedge members and the uprights, respectively.

19. Clamping arrangement according to claim 17, characterized in that said wedging-in means consist of holes (24) for the receipt of screws, the holes having an elongate shape in order to enable axial movement of the clamping device in relation to a mounting pocket.

20. Clamping arrangement according to claim 16, characterized in that the individual wedge member has two opposite wedge surfaces (30, 31), which converge in the direction upward.

* * * * *